US005487542A

United States Patent [19]

Foley

[11] Patent Number: 5,487,542

[45] Date of Patent: Jan. 30, 1996

[54] AUTOMATICALLY-SCORING GOLF GAME

[76] Inventor: Thomas P. Foley, 518 Red Oak Dr., Severna Park, Md. 21146

[21] Appl. No.: 408,044

[22] Filed: Mar. 21, 1995

[51] Int. Cl.[6] ..... A63B 69/36; A63B 67/02

[52] U.S. Cl. ..... 273/176 FA; 273/184 R; 273/186.2; 273/162 A; 273/213; 273/34 R; 273/176 E

[58] Field of Search ..... 273/186.2, 186.3, 273/184 R, 185 R, 213, 162 A, 32 H, 176 FA, 176 R, 187.4

[56] References Cited

U.S. PATENT DOCUMENTS

| | | | |
|---|---|---|---|
| 1,840,406 | 11/1930 | McEvoy | 273/162 A |
| 3,104,879 | 7/1961 | Jetton | 273/176 |
| 3,380,305 | 4/1968 | Charell | 273/186.2 X |
| 3,806,131 | 4/1974 | Evans | 273/186.2 |
| 3,891,221 | 6/1975 | Gordon | 273/177 R |
| 4,283,057 | 8/1981 | Ragan | 273/186.2 |
| 4,940,236 | 7/1990 | Allen | 273/184 R X |
| 4,991,850 | 2/1991 | Wilhlem | 273/186 A |
| 5,056,106 | 10/1991 | Wang et al. | 273/213 X |
| 5,127,044 | 6/1992 | Bonito et al. | 273/176 L X |
| 5,132,622 | 7/1992 | Valentino | 273/213 X |
| 5,354,052 | 10/1994 | Nicholls et al. | 273/34 R |
| 5,370,389 | 12/1994 | Reising | 273/213 X |
| 5,395,116 | 3/1995 | Blaakman | 273/186.2 X |

*Primary Examiner*—George J. Marlo
*Attorney, Agent, or Firm*—Browdy and Neimark

[57] ABSTRACT

A golf game uses radio signals from golf clubs to signal to a central computer for automatic score-keeping by the computer. Sensors in each hole also send signals to the computer on the completion of each hole play for each golfer. The golf clubs are distinguishable by the computer according to their radio frequencies or digital or other signal processing and coding encoding. The golf clubs include transmitters in their handles which emit radio signals when the clubs are struck against preferably special golf balls, which incorporate magnets or other sensed qualities in their structure; the clubs include magnetic or other corresponding sensors. Each player, upon starting the game, inputs his/her name or initials along with an identification of the specific club he/she has selected to use on the course. Scores are reported optionally at each hole, and a final score is reported by the computer at the conclusion of play.

20 Claims, 7 Drawing Sheets

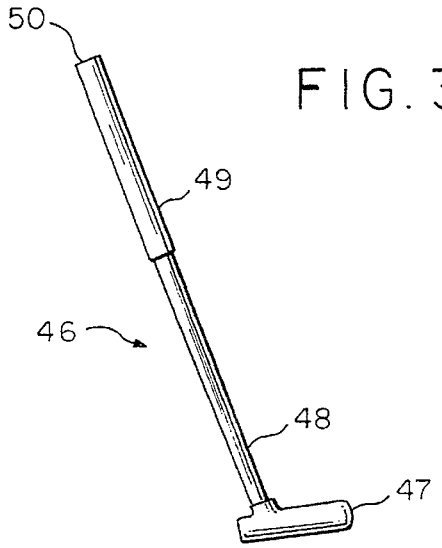
FIG. 3A
FIG. 3B
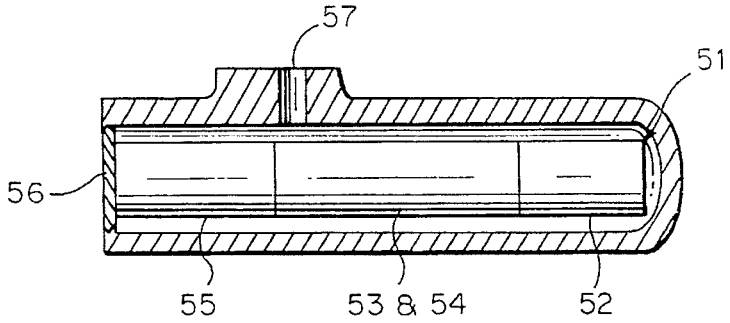
FIG. 3C
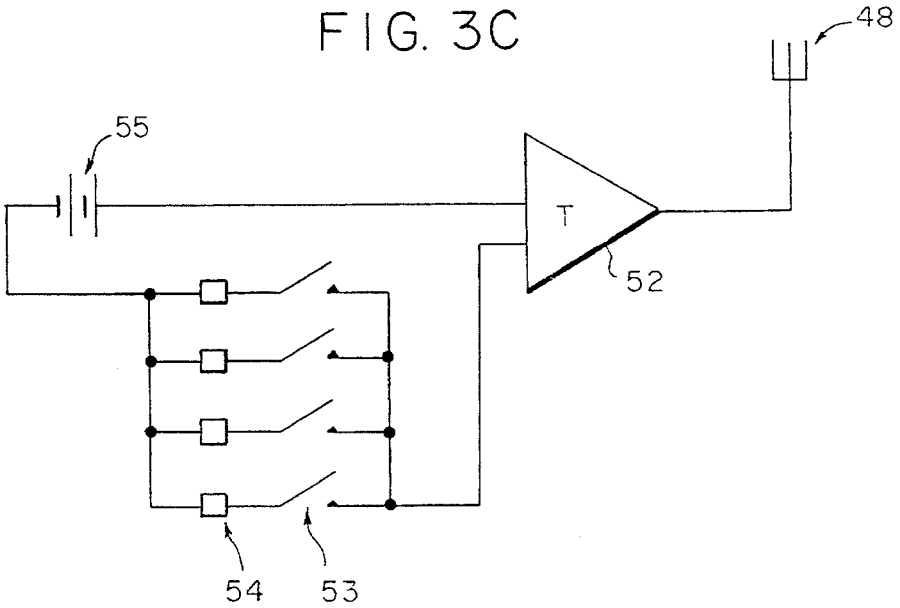

FIG. 5A

WELCOME!!

- PLEASE TYPE YOUR INITIALS AND CLUB NUMBER AND "ENTER"

INITIAL CLUB#

17

FIG. 5B

WELCOME!!

- PLEASE TYPE YOUR INITIALS AND CLUB NUMBER AND "ENTER"

| INITIAL | CLUB# |
|---|---|
| TPF | 64 |
| RTF | 114 |
| ACP | 81 |
| BJF | 92 |

- START PLAY NOW. EACH TIME YOU TOUCH THE BALL WITH THE PUTTER, A STROKE WILL REGISTER AUTOMATICALLY.

GOOD LUCK!

17

FIG. 5C

| PLAYER | SCORE |
|---|---|
| TPF | 3 |
| RTF | 1 |
| ACP | 2 |
| BJF | 2 |

PLEASE PROCEED TO NEXT HOLE

21 THRU 29

FIG. 5D

| PLAYER | | TPF | RTF | ACP | BJF |
|---|---|---|---|---|---|
| HOLE | 1 | 3 | 1 | 2 | 2 |
| | 2 | 1 | 2 | 1 | 2 |
| | 3 | 2 | 2 | 2 | 1 |
| | - | | | | |
| | - | | | | |
| | N | 2 | 1 | 1 | 1 |
| TOTAL SCORE | | 39 | 36 | 34 | 33 |

30

AUTOMATICALLY-SCORING GOLF GAME

BACKGROUND OF THE INVENTION

1. Field of the Invention

The present invention relates to games of the type having a ball, a plurality of clubs for striking the ball, and holes into which balls may fall, and more particularly to such games with automatic scoring devices.

2. Description of the Related Art

Mini golf has been in use for many years, with courses of typically 9 or 18 holes. Scoring is typically done manually by each player, sometimes resulting in arguments between players as to whether the proper score has been written by the player. Players also may lose scorecards or pencils, or may not wish to carry them. There is a need for automatic scoring of each player at each hole and for a central means for reporting scores to the players.

Several U.S. patents are concerned with the field of the invention.

Nicholls et al, U.S. Pat. No. 5,354,052, shows a golf course hole-in-one detector.

McEvoy, U.S. Pat. No. 1,840,406, shows a mechanical stroke counter attached to a golf club. The counter is augmented when a ball is struck.

Reising, U.S. Pat. No. 5,370,389, discloses golf balls which include bar codes for identification of the individual balls. FIG. 7 shows a computer 118 connected to a plurality of sensors.

Valentino, U.S. Pat. No. 5,132,622, shows a golf ball having a metal center which is magnetically detectable.

Wang et al, U.S. Pat. No. 5,056,106, shows radio location of golf course positions using different radio frequencies.

Gordon, U.S. Pat. No. 3,891,221, shows a magnetic golf ball. The magnetic properties of the ball are not used for sensing.

Jetton, U.S. Pat. No. 3,104,879, shows cables running to a central computer from various golf holes having golf ball sensors.

Golf clubs with impact sensors are disclosed by Wilhelm, U.S. Pat. No. 4,991,850, and by Allen, U.S. Pat. No. 4,940,236. Both employ piezo-electric sensors in the golf club head to register impact against golf balls. The sensors do not appear to distinguish between impacts with golf balls and other objects.

Other U.S. Pat. Nos. are: 5,056,106 to Wang et al; 3,436,076 to Barthol; 3,868,692 to Woodward et al; 4,220,992 to Blood et al; 4,660,039 to Barricks et al; 4,879,651 to Little, Jr.; 4,940,236 to Allen; and 4,991,850 to Wilhelm.

The prior art does not disclose any device which allows automatic score-keeping for each player.

SUMMARY OF THE INVENTION

Accordingly, the present invention has an object, among others, to overcome deficiencies in the prior art such as noted above.

The invention relates to, for example, a mini golf game, although the invention will work as well in any golf game. The invention provides that at the start of play of a golf game, each player keys into a computer keyboard his/her name or initials in conjunction with an identification of a particular golf putting club selected to play the game. All golf balls used for play are coded-magnetically, optically or otherwise to cause a response when struck by the club, which contains sensors to register when a stroke has been taken. The sensors in the club are connected to a low-power radio transmitter also contained in the club which signals a central receiver in a manner unique to each club, which receiver may be located in proximity to the central computer. Thus, the computer is capable of receiving and storing the number of strokes taken by the player. Sensors in each putting hole, either optical, magnetic or otherwise, also alert the computer that a ball being played towards that hole has entered the hole, allowing the computer to determine that the player last striking a ball has completed that hole. Displays of the number of strokes taken by each player are located at each hole area, and a final display of the sum of all strokes taken during play is located at the final hole. Also located at the final hole is a printer to print out the score, total as well as hole-by-hole, for each player.

BRIEF DESCRIPTION OF THE DRAWING

The above and other objects and the nature and advantages of the present invention will become more apparent from the following detailed description of an embodiment taken in conjunction with drawings, wherein:

FIGS. 3A, 3B, 3C and 3D show one method of detecting strokes by the club, and transmitting such strokes to a central receiver and computer;

FIGS. 5A, 5B, 5C and 5D depict the various displayed information used in the system.

DETAILED DESCRIPTION OF THE PREFERRED EMBODIMENT

Figure 1:
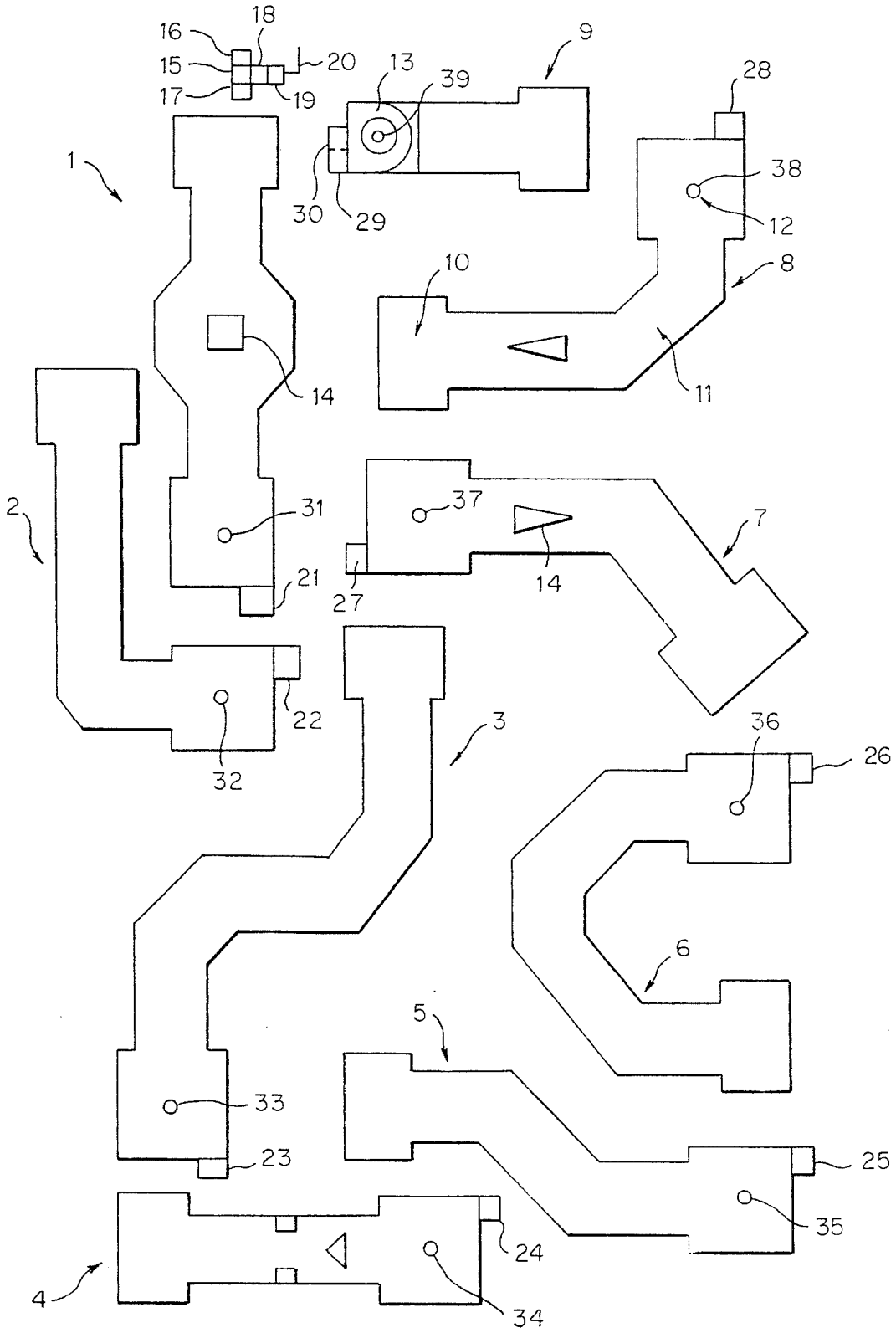
FIG. 1 is a plan view of a golf course according to the invention.

A plan view of a nine-hole mini-golf course is shown in FIG. 1. Each of the golf holes 1 through 9 contain a tee area 10, a fairway 11 and a golf hole 12. The final hole usually contains a target 13, which retains the golf balls for further use. Fairways are typically distorted and/or contain obstructions 14, which test the skill of the players. A computer 15, with its keyboard 16, display 17, and printer 18 is located adjacent to the tee of the first hole 1. Also collocated with the computer 15 is a receiver 19, with its antenna 20, the function of which will be described below. Adjacent to each golf hole 1 through 9 are displays 21 through 29, wired to computer 15 to display each players' golf score for that hole. A final display 30 gives the total score for each player in their foursome. Golf holes 31 through 39 each contain sensors which are wired to computer 15 to signify the presence of a golf ball in that hole.

Figure 2A:
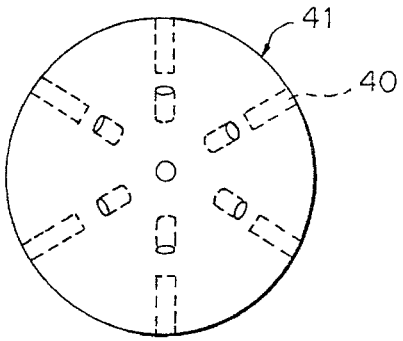
FIGS. 2A, 2B, and 2C illustrate some methods of coding the golf balls used in the invention.
Figure 2B:
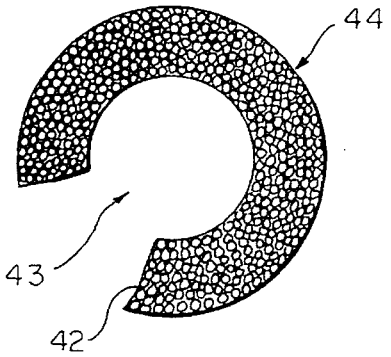
Figure 2C:
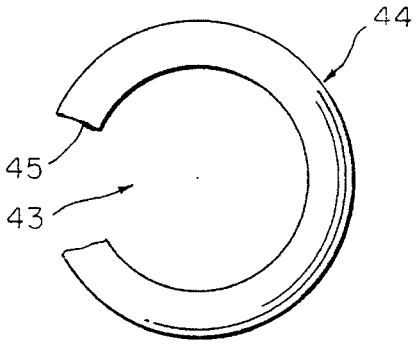

Prior to the start of play, each player of a mini-golf foursome (or less) is provided with a golf ball constructed to emanate a weak magnetic field around its spherical area. Several methods of construction of such magnetically-responsive golf balls are given in FIG. 2. In FIG. 2A, previously magnetized metal rods 40 are imbedded around the spherical area of the ball 41. In FIG. 2B, previously magnetized particles 42 are molded between the ball core 43 and cover 44. In FIG. 2C, sections of previously magnetized strip 45 are cemented to a golf ball core 43 prior to applying the cover 44.

Each player then selects from one of many golf clubs, putters in the case of mini golf, individually numbered and constructed to transmit a signal from a low powered transmitter actuated when the putter head comes in close proximity to a magnetized golf ball. Each of the many putters is individually coded, by frequency, digital code, or other means, to correspond to the number printed on the top of the club grip. For a 9-hole mini-golf course, for example, at least 36 such clubs would be required if a foursome were playing on each hole. For an 18-hole course at least 72 such clubs would be required.

The construction of the magnetically-activated golf club transmitter is given in FIG. 3. FIG. 3A identifies the parts of the golf putter 46 as the putting head 47, shaft 48, grip 49, and the numbered plate 50. In FIG. 3B, a cross section of the putting head 47 is shown to contain a cavity 51 which holds a transmitting module 52, a module containing magnetic sensors 53 with impact sensors 54, and a replaceable battery 55, all held in place by a screw-in cover 56. A hole 57 through the top of the putting head 46 allows the transmitter 52 to be connected by a wire to the club shaft 48 which acts as a transmitting antenna. FIG. 3C is a schematic diagram of the putting head components. The transmitter 52 is energized through any of a set magnetically-actuated sensing switches 53, each of which is connected in series with an impact sensor 54, and battery 55 to transmit a coded pulse through antenna 48, which is the putting club's shaft.

Figure 3D:
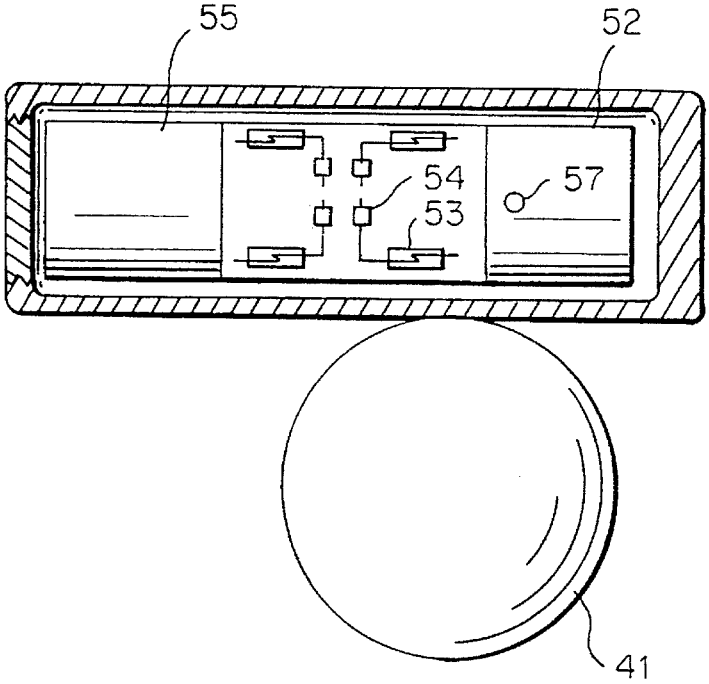

FIG. 3D shows a top view of a putting head 47 at the moment a magnetized golf ball 41 is struck. The weak magnetic field emanated by the ball 41 closes a magnetically-actuated switch 53, and the ball strike also closes impact sensor 54. This allows transmitter 52 to be connected to battery 55, thus energizing a transmitted signal through transmitter port 57, which connects to the metal club shaft antenna 48. Four (or more) magnetically-actuated switches 53 are used each in series with an impact sensor 54, all connected in parallel, to allow for players' variations in striking the ball at any point along the club face and to accommodate right or left-handed players. The outer material of the putting head 47 is aluminum or hard rubber or any nonferrous material, with sufficient wall thickness to prevent wall collapse during normal use, while thin enough to allow the magnetic field of the ball 41 to close one of the magnetically- actuated switches 53 and to register ball impact by impact sensor 54.

Figure 4:
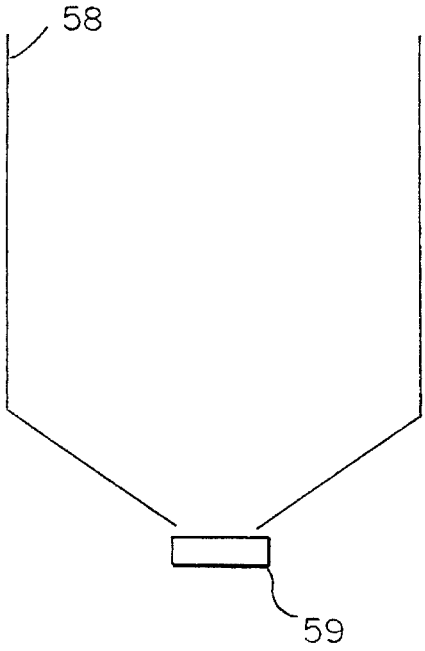
FIG. 4 shows an arrangement that may be used in each hole for sensing the completion of play at that hole.

In addition to the magnetized golf ball and putter-transmitter described above, each golf hole is constructed as shown in FIG. 4. The body of each golf hole 58 is built out of plastic or any other non-magnetic material. At the base of each hole, a magnetically-activated switch 59 is located to sense the presence of a magnetically-treated golf ball.

As each player in a foursome (or less) approach the first hole's tee area, the computer display 17 is as shown in FIG. 5A, which requests each player to enter their initials and club number via the keyboard 16. When all players have entered their data, the display is as shown in FIG. 5B, informing that group to begin play. The computer 15 is programmed to start scoring for each entered player until a hole sensing switch 38 is closed, which will alert the computer 15 that the player whose last stroke was received on that hole has completed that hole. When all players of a group complete each hole 1 through 9 successively, the displays 21 through 29 at each hole present the display given in FIG. 5C. When the final hole 9 has been completed by all players in a group, the final display 30 presents the information of each player's score at each hole, and total score, as shown in FIG. 5D. This information is also printed for players retention by printer 18.

Figure 6:
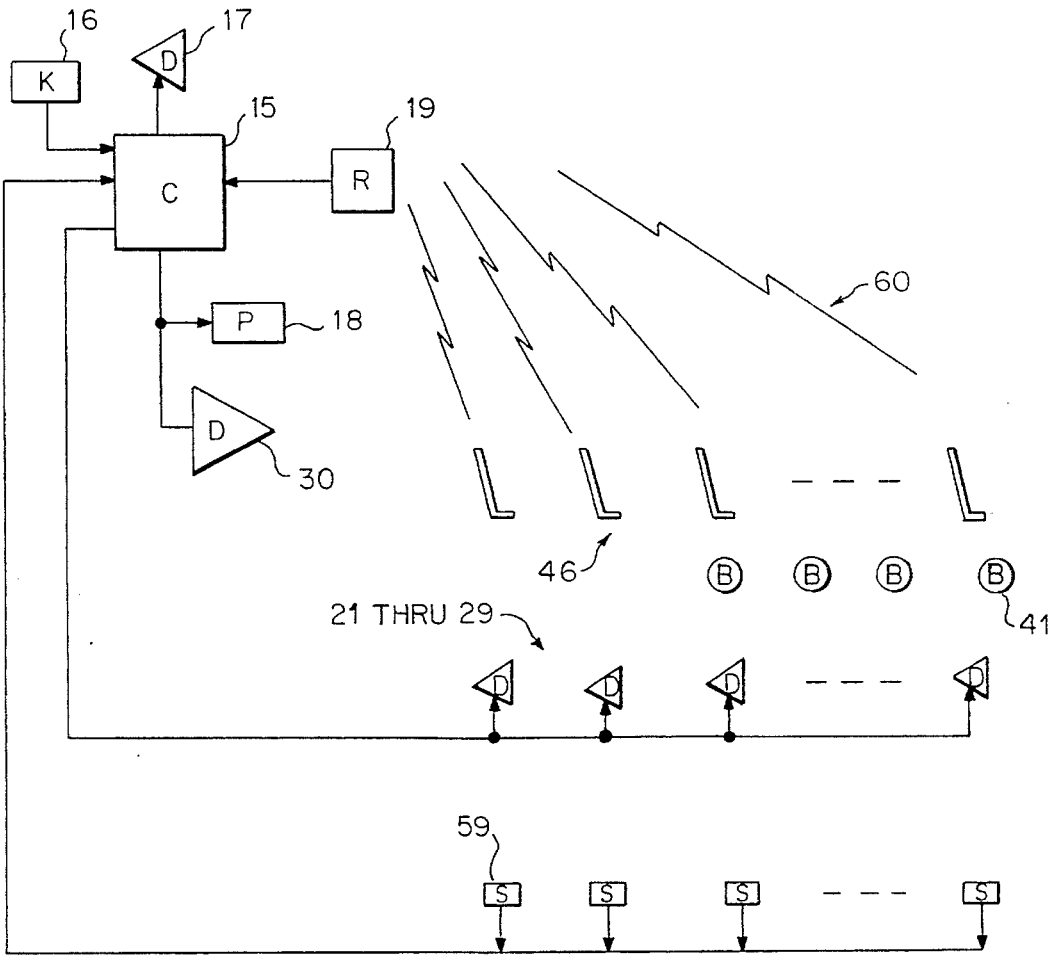
FIG. 6 illustrates a block diagram of the entire automatic-scoring golf course.

A block diagram of components of the Automatically-Scoring Golf Game is given in FIG. 6. Computer 15 receives inputs from keyboard 16, receiver(s) 19 and each of the hole sensors 38. Golf clubs 46 sense strokes of golf balls 41 and transmit such information 60, each separately coded by frequency, digital code, or other multiplexing means, to receiver(s) 19 for storage by computer 15, and later scoring use. Computer outputs are to the entry display 17, intermediate hole displays 21 through 29, final display 30, and printer 18.

An alternative stroke sensing system is given in FIG. 7, where the magnetic ball is replaced with an optically-coded ball using spherically-recognized markings and the club sensing devices are a scanning optical device in conjunction with an impact sensor. For this alternate system, a similar scanning optical device would also be used as the golf hole sensor. One advantage of this alternative is that each ball may then be coded differently, thus allowing unique ball identification with a particular player. All other aspects of the automatically-scoring golf gam remain the same as given previously.

Figure 7A:
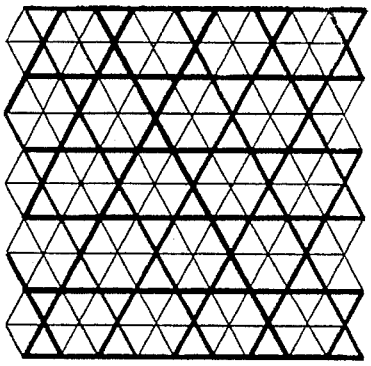
FIGS. 7A, 7B and 7C show an alternative stroke-sensing method.

To further illustrate this alternative, FIG. 7A gives an example of one of several possible spherically-adaptable optically-recognizable codings which may be imprinted on the ball. The scanning beam width is adjustable to assure that the beam would read the coded lines as well as the spaces between the lines regardless of the ball aspect. The scan angle of the scanning beam may also be alternated between scans to assure that the desired coded line-space separation required by the line reader is maintained for a spherical object. The ball codings and scanner may be either visible or infra-red.

Figure 7B:
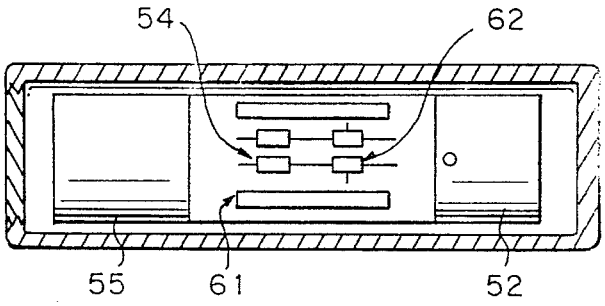

FIG. 7B shows the club head construction using this alternative. The battery module and transmitter module are as previously described. The scanning module for this alternative contains a pair of optical scanners 61, one inside each right or left club face, powered by the battery 55, and either used to energize solid state switches 62 connected in series with impact sensors 54, to energize transmitter 52.

Figure 7C:
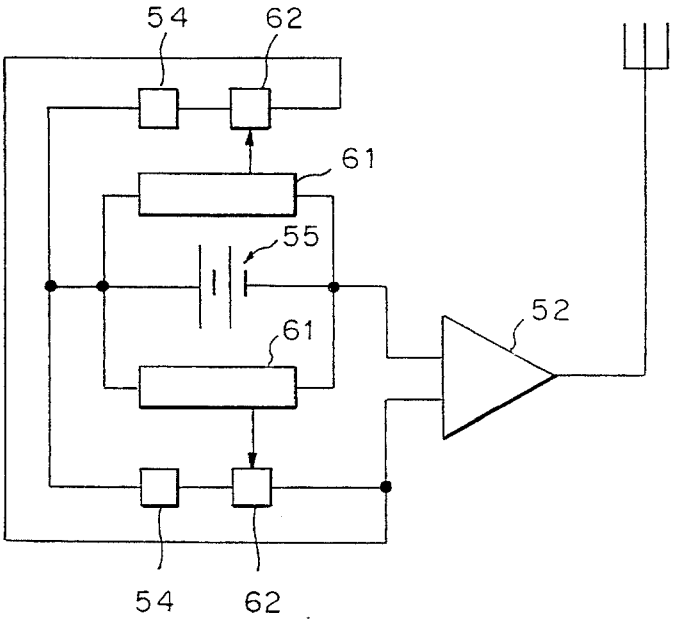

FIG. 7C is a schematic diagram of this configuration. As the ball is struck, scanner 61 reads the ball pattern,energizing switch 62. Simultaneously, impact sensor 54 registers ball impact and closes the circuit between battery 55 and transmitter 52.

A further alternative substitutes a magnetic pattern coding on the ball and magnetic code readers in the clubs and golf holes. Except for the magnetic vs. optical sensing, the system is identical to that previously described.

The foregoing description of the specific embodiments will so fully reveal the general nature of the invention that others can, by applying current knowledge, readily modify and/or adapt for various applications such specific embodiments, without departing from the generic concepts, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a game for players, of the type having a ball, a plurality of clubs for striking the ball, and holes into which the ball may fall, and wherein scores are maintained, the improvement comprising:

a ball-strike sensor associated with each respective club;

a transmitter associated with each respective club, the transmitter being coupled to the ball-strike sensor of the respective club for emitting a signal upon striking the ball, the signal being unique to the respective club and distinguishable from signals of all others of the clubs;

receiver means for receiving the signals, the receiver means including signal identifying means for determining the respective club which has struck the ball;

processing means for calculating and keeping scores, the processing means being coupled to the receiver means;

ball-in-hole sensors, coupled to the processing means, for reporting presence of the ball in each of the holes; and score-displaying means, coupled to the processing means, for selectively exhibiting a score of the respective club.

2. The improvement according to claim 1, wherein the ball-strike sensor includes means for distinguishing ball contact from other contacts with objects other than the ball.

3. The improvement according to claim 2, wherein the ball includes means for generating a permanent magnetic field and the ball-strike sensor includes a magnetic sensor responsive to the magnetic field, wherein the club sends the signal to the processing means only when the ball is struck.

4. The improvement according to claim 3, wherein the club includes a ball-striking face, the face includes a cover of non-magnetic material, and the magnetic sensor is disposed in adjacent the face behind the material.

5. The improvement according to claim 2, wherein the ball-strike sensor includes selectively a force sensor, an optical sensor, and a magnetic sensor.

6. The improvement according to claim 2, wherein the ball includes selectively optical and magnetic properties, the ball-strike sensor includes a force sensor, and the ball-strike sensor includes an other sensor being selectively an optical sensor and a magnetic sensor responsive to selectively the optical and magnetic properties of the ball.

7. The improvement according to claim 2, further including a plurality of the ball, and wherein each one of the balls includes an infra-red optical identification marking, and the ball-strike sensor includes an impact sensor and an optical scanner for reading the identification marking of each one of the balls.

8. The improvement according to claim 2, further including a plurality of the ball, and wherein each one of the balls includes a unique identification marking being selectively an optical marking and an electronic marking, and the ball-strike sensor includes means for reading the identification marking of each one of the balls.

9. The improvement according to claim 1, wherein the transmitter includes an antenna in an elongated handle of the respective club.

10. The improvement according to claim 1, wherein the clubs include respective unique identifying indicia observable by the players and the score-displaying means selectively shows the indicia when reporting scores.

11. The improvement according to claim 1, wherein the score-displaying means includes a plurality of hole displays, each of the hole displays being located adjacent a respective one of the holes.

12. The improvement according to claim 1, wherein the score-displaying means includes a printer for making a hard copy of a final score.

13. The improvement according to claim 1, wherein the score-displaying means includes an input device and a confirmation display of player names.

14. The improvement according to claim 1, wherein the score-displaying means provides information including selectively player names, order of play, hole scores, hole-in-one announcements, instructions, and final scores.

15. The improvement according to claim 1, wherein the score-displaying means includes selectively voice announcements, audible alarms, and lights.

16. The improvement according to claim 1, wherein the signals are distinguishable by incorporating various different electronic signal processing methods.

17. The improvement according to claim 16, wherein the signals are distinguishable selectively by being transmitted on various different radio frequencies, incorporating various different digital codes, digital compression, and selectively phase coding and other signal processing methods.

18. In a plurality of clubs for striking balls, the improvement comprising:

a ball-strike sensor associated with each respective club;

a transmitter associated with each respective club, the transmitter being electrically coupled to the ball-strike sensor of the respective club for emitting an electrical signal upon striking the ball, the signal being unique to the respective club and distinguishable from signals of all others of the clubs whereby any of the plurality of clubs may be identified upon striking a ball.

19. The improvement according to claim 18, wherein the transmitter includes an antenna in an elongated handle of the respective club.

20. The improvement according to claim 18, including a ball wherein:

the ball includes selectively optical patterns and magnetic fields; and the ball-strike sensor includes, for distinguishing ball contact from other contacts with objects other than the ball, selectively a force sensor, an optical sensor, and a magnetic sensor.

* * * * *